US006745810B1

(12) United States Patent
Moreno et al.

(10) Patent No.: US 6,745,810 B1
(45) Date of Patent: Jun. 8, 2004

(54) HANDLE OPERATED MODULAR WINDOW SHADE SYSTEM FOR MOVING A SHADE VERTICALLY A DISTANCE LESS THAN THE DISTANCE OF HANDLE TRAVEL

(75) Inventors: Gilbert Moreno, San Antonio, TX (US); Eduardo Sanz, San Antonio, TX (US); Michael Spraggins, San Antonio, TX (US)

(73) Assignee: MSA Aircraft Interior Products, Inc., San Antonio, TX (US)

( * ) Notice: Subject to any disclaimer, the term of this patent is extended or adjusted under 35 U.S.C. 154(b) by 0 days.

(21) Appl. No.: 10/027,633

(22) Filed: Dec. 21, 2001

Related U.S. Application Data

(60) Provisional application No. 60/260,065, filed on Jan. 5, 2001.

(51) Int. Cl.[7] ..... A47H 1/00

(52) U.S. Cl. ..... 160/97; 160/90; 160/84.01

(58) Field of Search ..... 160/97, 90, 84.01, 160/89, 188, 309, 321, 107, 172

(56) References Cited

U.S. PATENT DOCUMENTS

| | | | | | |
|---|---|---|---|---|---|
| 4,673,018 | A | * | 6/1987 | Judkins | 160/84 R |
| 4,679,610 | A | | 7/1987 | Spraggins | 160/107 |
| 4,762,159 | A | | 8/1988 | Ford | 160/84 |
| 4,817,698 | A | * | 4/1989 | Rossini et al. | 160/107 |
| 4,852,627 | A | * | 8/1989 | Peterson et al. | 160/84.1 |
| 4,917,167 | A | | 4/1990 | Voss et al. | 160/84 |
| 4,998,576 | A | | 3/1991 | Moreno | 160/90 |
| 5,082,043 | A | | 1/1992 | Moreno | 160/90 |
| 6,119,756 | A | * | 9/2000 | Tatro | 160/107 |
| 6,230,784 | B1 | * | 5/2001 | Sanz et al. | 160/84.02 |
| 6,481,486 | B1 | * | 11/2002 | Sanz et al. | 160/84.06 |
| 2003/0085001 | A1 | * | 5/2003 | Sanz et al. | 160/84.04 |

FOREIGN PATENT DOCUMENTS

| | | | | |
|---|---|---|---|---|
| FR | 2583092 | * | 12/1986 | 160/107 X |

* cited by examiner

*Primary Examiner*—Bruce A. Lev
(74) *Attorney, Agent, or Firm*—Jackson Walker, LLP

(57) ABSTRACT

Applicant discloses a modular window shade system for an aircraft or other vehicle. The window shade of the window is enclosed with an outer and inner lens and mounted to a frame. A handle is provided and a mechanism is provided where in moving a handle horizontally mounted to the frame will cause the shade to move vertically. The mechanism between the handle and the shade provides a mechanical advantage such that the handle moves a distance greater then the vertical travel of the shade.

20 Claims, 4 Drawing Sheets

HANDLE OPERATED MODULAR WINDOW SHADE SYSTEM FOR MOVING A SHADE VERTICALLY A DISTANCE LESS THAN THE DISTANCE OF HANDLE TRAVEL

This application is based on and claims priority from provisional patent application, Serial No. 60/260,065, filed Jan. 5, 2001.

Applicant incorporates by reference the specifications and drawings of the following patents: U.S. Pat. Nos. 4,679,610, 5,082,043 and 4,998,576.

BACKGROUND OF THE INVENTION

Windows designed for application in a aircraft environment have some unique requirements. They must be lightweight and capable of withstanding some flexing as is found in the fuselage of an aircraft. Some of the aircraft window designs are modular, See for example U.S. Pat. No. 4,679,610 the specifications of which are incorporated wherein by reference. The '610 patent discloses a lightweight modular aircraft window for installation into the interior of the fuselage of an aircraft and having an inner pane and an outer pane, with a shade between the two panes. The shade uses a mechanical linkage between a handle, accessible from the inside of the aircraft to the shade so that movement of handle will collate into vertical movement of the shade between an opened and a close position. Typically, the handles are mounted to slide horizontally back and forth and generate a vertical motion up and down of the window shade between an open and close position. Thus, some type of mechanical linkage is required. A variety of such linkages are disclosed in the prior art and include block and tackle systems, lead screws and gears as well as various combinations of these elements. Sometimes, these linkages generate a one to one movement-meaning that for a given different distance of horizontal travel the shade will move an equal distance vertically. However, a need has developed, especially in "tall" windows for mechanical advantage providing a vertical movement of the window being some multiple of the horizontal movement of the handle. Examples of such mechanism may be found in U.S. Pat. Nos. 5,082,043 and 4,998,576 the specifications of which are incorporated wherein by reference.

Lead screws have been used to drive window shades (See U.S. Pat. No. 4,998,576). However, the use of lead screws to move window shades has been limited to lead screws which provide a mechanical advantage between the lead screw and the window shade movement. By this it is meant that the lead screw is utilized in conjunction with a handle so that movement of the handle horizontally will move a shade vertically a distance greater than the movement of the handle laterally on the lead screw.

Applicant's, however, have found utility in providing a combination of lead screw with a mechanical change having a distance multiplier at the output, that is, where the movement of a handle mounted along the lead screw results in less movement of the shade. The trade off made in Applicant's unique window is a decrease of the force necessary to move the handle horizontally but an increase in the distance required to move the handle. Such a trade off may be effective where the shade is wider than the distance it must move vertically between an opened and a closed position or where a decreased force on the handle is desired. For example, a specific application may be in a modular aircraft window shade system having a shade that will cover more than one fuselage window.

In some aircraft applications it is desirable to have a single shade and a single modular shade system to cover two or more window openings. In many applications a modular window shade system will have a single inner lens and single shade to cover two or more window openings. For such applications the width of the shade is usually greater than the distance between a full open and a full closed shade position (wherein sometimes referred to as "vertical travel"). On such a "wide window" (wherein the width of the window shade is greater than the vertical travel) applicant has found that some type of mechanical distance multiplier such as, a handle operated lead screw, is advantageous wherein a lead screw mounted sprocket drives the shade. This mechanical advantage trade off between force and distance is important because a wide window has a longer shade rail, and shade meaning a heavier shade rail and shade. Using a mechanical advantage force/distance tradeoff, the lifting force, applied to the handle to lift the shade rail, is decreased with a simultaneous increase in handle travel distance. This provides for a low effort (low force) of handle operation to move the shade vertically a distance less than the movement of the handle (hereinafter sometimes referred to as "handle travel").

A second manner of achieving mechanical linkage between a horizontally moving handle and a vertical shade movement is the use of moveable pulleys, such as those disclosed in the '043 patent. However, the moveable pulleys found in the '043 patent are handle mounted and operate to move the shade a distance greater (rather than a distance smaller) than the movement of the handle.

Applicant provides herein, a manner of providing moveable pulleys (operated by cables engaging the handle and pulleys) to a shade rail to move the shade rail a vertical distance less than the movement of the handle. This mechanism provides the same result as the lead screw disclosed herein-that is, a result sometimes referred to as a distance multiplier."

SUMMARY OF THE INVENTION

Applicant's provide a modular window shade unit having a frame and an inner lens wherein the width of the shade is greater than the distance between the open and close position of the shade. The window shade unit encloses a shade having a shade rail moveable with respect to the frame and attached to the shade. The modular shade window unit includes means, engaged with a handle, for engaging the frame and the shade rail such that movement of the handle a first distance causes the shade rail to move a second distance, the second distance less than the first distance.

Applicant's modular window shade unit also includes means for engaging a frame and shade rail that includes a pair of pulleys mounted to the shade rail and a cable fixed to a handle at the removed ends thereof the cable for engaging the pulleys of the shade rail.

Applicant's modular window shade unit having a frame in an inner lens includes means for engaging the frame and shade rail, including a rotatable lead screw mounted to the frame for engaging the handle through a coupler, the means for engaging including a sprocket and belt means, the belt attachable to the moveable shade rail such that movement of the handle rotates the lead screw which rotates sprockets and moves the belt and the shade rail.

DETAILED DESCRIPTION OF THE PREFERRED EMBODIMENT

Figure 1:
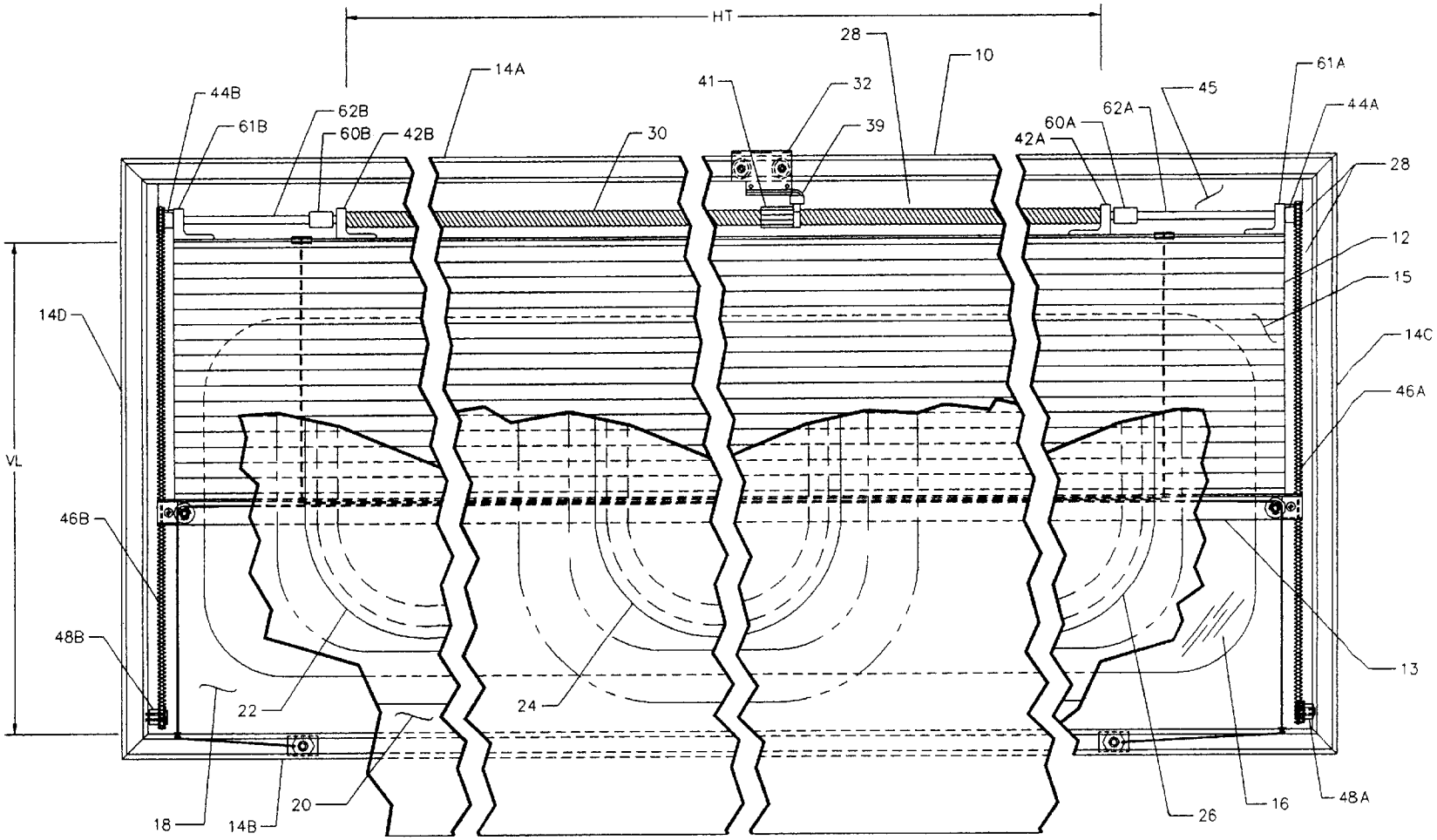
FIG. 1 is a rear elevation partially cutaway view of various components of Applicant's unique window 10.

FIG. 1 is a rear elevation partially cutaway view of various components of Applicant's unique window 10. The aircraft window is modular and generally rectangular for mounting into the interior of an aircraft. Moreover, Applicant's aircraft window 10 is seen to comprise a shade 12 mounted within a frame 14 the shade comprised of a shade material 15. The shade includes a movable shade rail 13 which is attached to the lower edge of shade 12.

The frame is typically rectangular and made of metal rails or members, including top member 14A, bottom member 14B, side member 14C and side member 14D. Frames, such as frame 14 are constructed of materials and in ways known in the trade. In cross section the window unit is curved, to match the curve of the interior walls of the cabin (See U.S. Pat. No. 4,679,610).

Mounted to the frame is an inner lens 16, typically made of plastic or Lexan®. Mounted to the frame is an outer reveal 20, the outer reveal including walls defining one or more openings, here preferably three: 22, 24 and 26. Just inside the inner surface of the inner lens 16 and mounted adjacent the perimeter thereof is a mask 18 designed to hide (or "mask") mechanical components along the top, bottom and two side rails of the frame.

The outer reveal is attached along the perimeter to the frame. It typically defines, in Applicant's invention, two or more outer lens openings. Any of these lens openings may, optionally, include an outer lens.

FIG. 1 illustrates some of the components of Applicant's window shade drive mechanism 28. More particularly in FIG. 1 it is seen that Applicant's provide a rotatable lead screw 30 which is attached to lead screw end brackets 42A and 42B that are attached to "L" shaped bracket 45. Bracket is then attached to top frame member 14A.

Figure 2A:
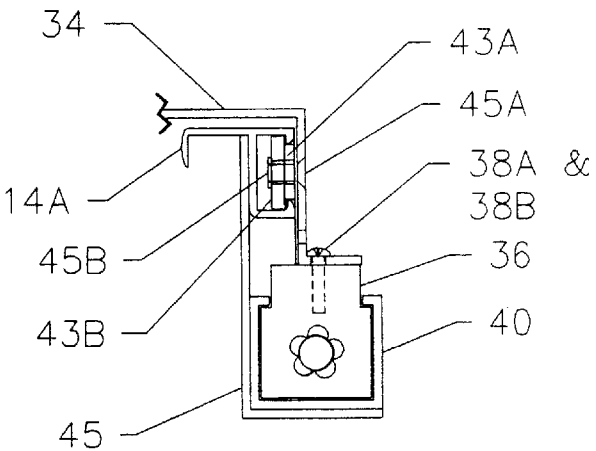
FIGS. 2 and 2A are two embodiments in cross-sectional elevation views of a handle for use without Applicant's novel window.
Figure 2:
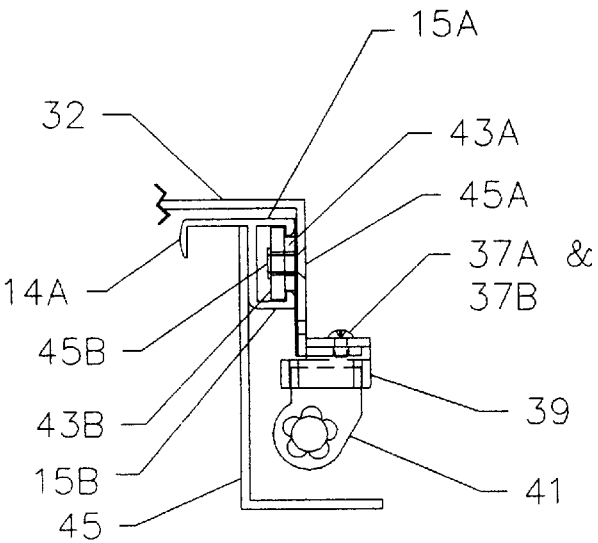

FIGS. 1 and 2 illustrate the preferred embodiment of mounting handle 32 to top frame member 14A. More specifically, it is seen that handle 32 is attached to top frame member by first washer 43A and a second washer 43B. The second washer has a greater diameter than the diameter of the first washer. Both washers may be nylon. They are attached to the handle by counter sunk screw 45A passing through handle 34 and first and second washer, finally engaging standoff 45B. First and second washer are stacked to partially enclose the arms 15A and 15B of the top frame member and therein effectively create a slider mechanism analogous to that used in the embodiment set forth in FIG. 2.

Handle 32 is attached to lead screw by retainer 39, typically removed from the grasping end of handle, attached to handle by two screws 37A and 37B. The retainer is attached to lead screw nut 41 which is mounted to lead screw 30. Typically, retainer has a "C" shaped cross section at one end that slips over the flange of the lead screw nut. Grasping the handle and moving it parallel to the lead screw will affect rotation of the lead screw. The amount of rotation of the lead screw per unit distance of handle travel is determined by the "lead" distance of the lead screw.

More specifically, attached to the removed ends of the lead screw are a pair of couplers 60A and 60B, end brackets 61A and 61B, and shafts 62A and 62B to which a pair of driver sprockets 44A and 44B are attached. These sprockets have a circumference determined by their diameter. These drive sprockets engage drive belts, typically toothed, 46A and 46B. The toothed belts extend between the drive sprockets, that are mounted in the upper left hand and right hand corners of the frame, and a pair of freewheeling return sprockets, 48A and 48B that are mounted in the lower left hand and right hand corners of the frame. The toothed belts are attached to the removed ends of the shade rail so that movement of the handle causes the belt and shade rail to move.

When the horizontal distance traveled by the handle is such that it causes one revolution of the lead screw and that lead distance is greater than the pitch circle distance of the drive sprockets, then the distance the shade moves will be less than the distance the handle moves and the force required to move the handle will be less than if the ratio of the handle movement to shade movement were 1:1. This is the nature of Applicant's lead screw 30 and drive sprocket combination horizontal movement of the handle will cause the shade to move a distance less than that horizontal movement.

Notice in FIG. 1 HT is the horizontal travel distance for the handle and VT is the vertical travel distance that the shade moves between opened and close position. Typically, the HT will be greater then VL.

FIG. 2A illustrates an alternate embodiment of attachment of the handle to the lead screw. A collar 36, typically nylon, and rifled to match the threads of the lead screw, is mounted to the handle by two screws 38A and 38B passing through the handle and into matching threaded holes in the collar. The collar is mounted onto the lead screw and then to "C" shaped channel 40 (see cross-sectional view) which is seen to fit snuggly around the body of the sliding collar 36. Channel 40, in turn is typically mounted to "L" shaped bracket 45. Bracket 45 is attached to top frame member 14A. Channel 40 extends substantially the length of the threaded screw and adjacent thereto.

Figure 3:
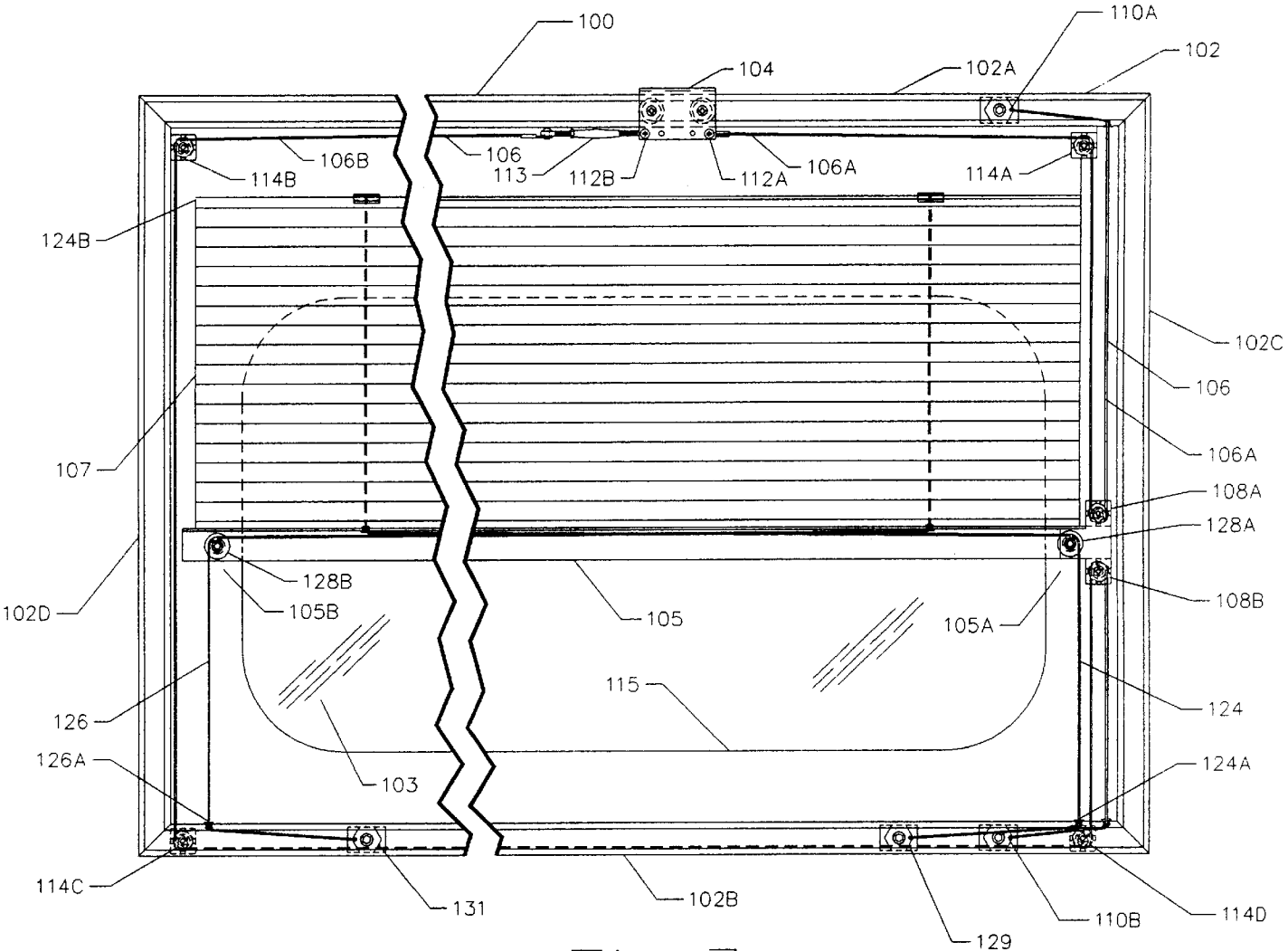
FIG. 3 is a rear elevation view of an alternate preferred embodiment of Applicant's novel window 100.
Figure 4:
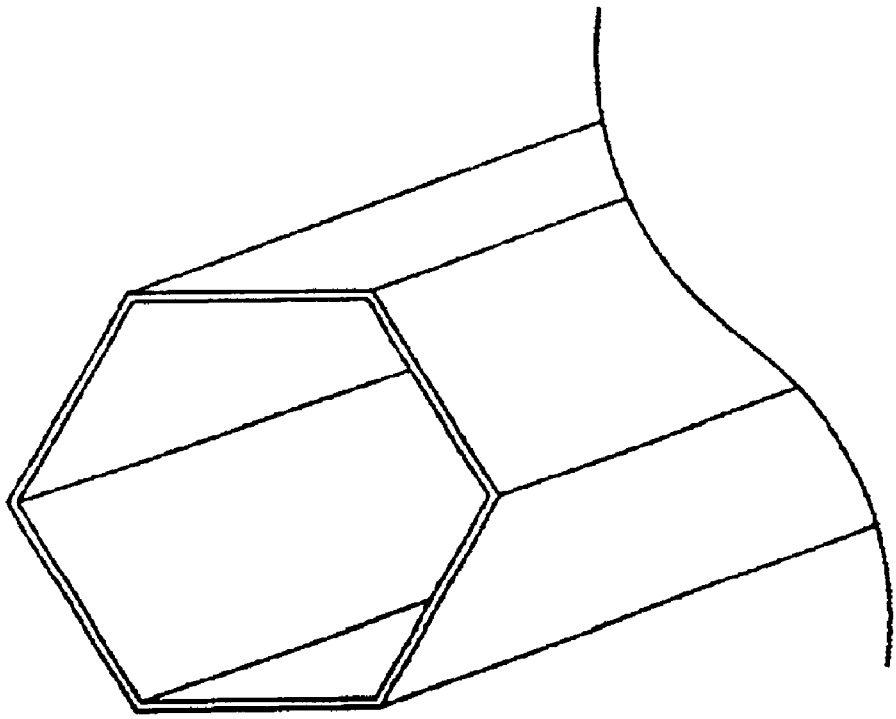
FIG. 4 is a perspective view of a pleated material having a polygonal cross section.

Turning now to FIG. 3 an alternate preferred embodiment of Applicant's present invention is provided in an aircraft window 100 having a typically rectangular frame 102, the frame made up of top frame member 102A, bottom frame member 102B and side frame members 102C and 102D. The four members are joined at corners by braces or other means known in the trade. Attached to the perimeter of the frame at an inner edge thereof is inner lens 103, typically clear Lexan® and curved, as the frame is curved (in cross section) to approximate the curve of the cabin of the aircraft. A handle 104 is mounted to a top frame member 102A (as, for example, by sliders interlocking with channel members, see FIG. 2), the handle may be grasped by an occupant of the aircraft cabin and moved horizontally, parallel to the top frame rail, to affect a sliding motion and cause the shade to move up or down between an opened and closed position. A movable shade rail 105 having a first end 105A and a second end 105B includes a shade 107 attached thereto, the shade, as in the previous embodiment, is typically is made of a pleated shade material such as Hunter Douglas Duette® or "Eclipse" or any other suitable material. The shade is attached at a lower edge to the shade rail at an upper edge to the upper frame member, 102A of the frame. Movement of the shade rail vertically as is illustrated in FIG. 3 will allow the shade to move between an opened and a closed position to control the amount of light entering or escaping the interior of the aircraft.

Applicant's alternate preferred embodiment of modular aircraft window 100 has a unique means for raising and lowering shade 107. Applicant provides a cable or cord 106 attached to the handle at attachment points 112A and 112B which cord is entrained on fixed pulleys around the perimeter of the window just inside the members of the frame and is attached to pair of movable pulleys located at one end of the shade rail in the following manner. The cable includes a first segment 106A and a second segment 106B. First segment 106A is attached to the frame at first segment tie in point 110A, here set forth in FIG. 3 in the upper right hand corner of the frame. Starting from 110A (adjustable tie in point), first segment 106A depends downward towards shade rail 105 where it engages first moveable pulley 108A, the first moveable pulley being attached to shade rail first end 105A. At this point, first segment 106A undergoes approximately 180 degree change of direction (being entrained on the first moveable pulley) and goes upward to fixed corner pulley 114A where it undergoes an approximately 90 degree change in direction and trends horizontally across the top of the aircraft window and just below upper frame 102A until it encounters handle 104 where it ties off to or at handle attachment point 112A. Similarly, a second cord segment 106B is found to tie off at second segment adjustable tie off point 110B, here in the lower right hand corner of the frame. From second segment tie off point 110B, second segment 106B trends upward toward the shade rail, where it encounters second movable pulley 108B, which, like the first movable pulley, is mounted to the first end 105A of shade rail 105. Here, second segment 106B undergoes approximately 180 degrees change of direction entrained as it is around the second movable pulley 108B and depends downward where its encounters fixed corner pulley 114D. Entrained on fixed corner pulley 114D, second segment 106B undergoes approximately 90 degree change of direction and trends parallel to and across the bottom of the window along lower frame rail 102B until, in the lower left hand corner as observed in FIG. 3, second segment 106B encounters fixed corner pulley 114C (lower left hand corner in FIG. 3). It undergoes a 90 degree change of direction and trends upward just inside side frame member 102D to fixed corner pulley 114B. Here it again undergoes a change of direction of approximately 90 degrees and trends, parallel and just below the frame upper frame rail 102A until it engages handle 104 at handle attachment point 112B. Note a turnbuckle 113 may help adjust tension in the cable, for example, to "take up" any slack in the cord. Springs may also be used to effect a dynamic tension in the cable.

FIG. 3 also shows an alignment means capable of maintaining the shade rail in an alignment parallel to the top and bottom frame members. The details of the alignment maintenance means may be appreciated with reference to the '610 patent. A pair of cables 124 and 126 tie in at a first end into the lower frame rail at adjustable tie in points 129 and 131. They go through a pair of holes 124A and 126A respectively in the lower frame member and trend upward just inside the side members of the frame and they encounter fixed shade rail mounted pulleys 128A and 128B, which are mounted to the removed ends of the shade rail. The two cables then partially crisscross and are directed upward through holes in the shade rail to tie in to the top rail 124B.

There is a mechanical advantage effect of providing a cable, tied in at its two ends to the frame and, between its two ends engaging a handle and a pair of shade rail mounted movable pulleys. This arrangement provides for movement of the handle a certain linear distance along the frame rail with movement of the shade rail a distance one-half times such handle movement. For example, if the handle is moved horizontally a distance of 8 inches, the shade will move vertically a distance of 4 inches. By providing such a mechanism, a reduced force mechanical "advantage" is achieved, meaning that the distance the handle is moved is increased, with the force on the handle decreased where the distance that the shade moves between an opened and a close position is decreased. In other words, mechanical advantage is a trade off between force and distance, here the trade off on the handle is that the distance it moves is increased while the force required to move the handle is decreased.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

We claim:

1. A modular window shade unit comprising:

a shade;

a frame and an inner lens;

a shade rail movable with respect to the frame and attached to the shade;

means for engaging including a handle, for engaging the frame and the shade rail such that movement of the handle a first distance causes the shade rail to move a second distance, the second distance being less than the first distance.

2. The modular window shade unit of claim 1 further including an outer reveal, the outer reveal defining at least two lens openings.

3. The modular window shade unit of claim 2 wherein the shade is made of a pleated material.

4. The modular window shade unit of claim 3 wherein the pleated material has a polygonal cross-section.

5. The modular window shade unit of claim 1 wherein the means for engaging a frame and the shade rail includes a pair of pulleys mounted to the shade rail and a cable fixed to the frame at the removed ends thereof the cable attached to the handle and engaging the pulleys of the shade rail.

6. The modular window shade unit of claim 5 further including a multiplicity of frame engaging fixed pulleys to entrain the cable thereon.

7. The modular window shade unit of claim 5 further including tensioning means to take up tension in the cable.

8. The window shade unit of claim 5 further including an outer reveal, the outer reveal defining at least two lens openings.

9. The modular window shade unit of claim 1 further including cables to maintain alignment of the shade rail.

10. The modular window shade unit of claim 9 further including the multiplicity of frame engaging fixed pulleys to entrain the cable thereon.

11. The modular window shade unit of claim 9 further including tensioning means to take up tension in the cable.

12. The modular window shade unit of claim 9 wherein the shade is made of a pleated material.

13. The modular window shade unit of claim 12 wherein the pleated material has a polygonal cross-section.

14. The window shade unit of claim 1 wherein means for engaging the frame and the shade rail includes a lead screw rotatably mounted to the frame and engaging the handle through a coupler, means for engaging further including a sprocket and a belt, the belt for attachment to the movable shade rail, such that movement of the handle rotates the lead screw which rotates the sprocket and moves the belt and shade rail.

15. The window shade unit of claim 14 further including an outer reveal, the outer reveal defining at least two lens openings.

16. The window shade unit of claim 14 wherein the shade is made of a pleated material.

17. The modular window shade unit of claim 16 wherein the pleated material has a polygonal cross-section.

18. The modular window shade unit of claim 14 wherein the handle includes a sliding nylon block for coupling the handle to the lead screw.

19. The modular window shade unit of claim 18 wherein the shade is made of a pleated material.

20. The modular window shade unit of claim 19 wherein the pleated material has polygonal cross-section.

* * * * *